US010983473B2

(12) United States Patent
Baba

(10) Patent No.: US 10,983,473 B2
(45) Date of Patent: Apr. 20, 2021

(54) DRUM CARTRIDGE INCLUDING A CLEANING MEMBER, FOR USE WITH AN IMAGE FORMING APPARATUS

(71) Applicant: CANON KABUSHIKI KAISHA, Tokyo (JP)

(72) Inventor: Daisuke Baba, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/672,948

(22) Filed: Nov. 4, 2019

(65) Prior Publication Data

US 2020/0150579 A1 May 14, 2020

(30) Foreign Application Priority Data

Nov. 13, 2018 (JP) ..... JP2018-212650

(51) Int. Cl.
*G03G 21/00* (2006.01)
*G03G 21/18* (2006.01)
*G03G 15/00* (2006.01)

(52) U.S. Cl.
CPC ..... *G03G 21/0058* (2013.01); *G03G 15/751* (2013.01); *G03G 21/1814* (2013.01); *G03G 2215/1657* (2013.01)

(58) Field of Classification Search
CPC ..... G03G 21/0058; G03G 15/751; G03G 21/1814; G03G 2215/1657
See application file for complete search history.

(56) References Cited

U.S. PATENT DOCUMENTS

| | | | | |
|---|---|---|---|---|
| 7,680,429 | B2 * | 3/2010 | Takaya | G03G 15/0225 399/100 |
| 2007/0292161 | A1 * | 12/2007 | Kikuchi | G03G 15/0233 399/176 |
| 2015/0355566 | A1 * | 12/2015 | Kikuchi | G03G 15/0266 399/176 |
| 2020/0233366 | A1 * | 7/2020 | Ishii | G03G 21/0088 |

FOREIGN PATENT DOCUMENTS

| | | | |
|---|---|---|---|
| JP | 2002049220 | A | 2/2002 |
| JP | 2003241467 | A * | 8/2003 |
| JP | 2006064835 | A | 3/2006 |
| JP | 2009003482 | A | 1/2009 |
| JP | 2010048869 | A | 3/2010 |
| JP | 2013061546 | A | 4/2013 |

* cited by examiner

*Primary Examiner* — Susan S Lee
(74) *Attorney, Agent, or Firm* — Rossi, Kimms & McDowell LLP

(57) ABSTRACT

A drum cartridge is mountable in and dismountable from an image forming apparatus without including a developing device. The drum cartridge includes an image bearing member, a charging member, and a cleaning member. The cleaning member includes an elastic layer contacting the charging member. The elastic layer includes a foam member and is made of a material having Asker-C hardness of 5-30 degrees.

9 Claims, 7 Drawing Sheets

DRUM CARTRIDGE INCLUDING A CLEANING MEMBER, FOR USE WITH AN IMAGE FORMING APPARATUS

FIELD OF THE INVENTION AND RELATED ART

The present invention relates to a drum cartridge which includes a PM and a charging member for electrically charging the photosensitive member and which is mountable in and dismountable from an image forming apparatus, and relates to the image forming apparatus such as, a copying machine, a printer or a facsimile machine, or an electrostatic recording apparatus, including the drum cartridge.

In a conventional the image forming apparatus using an electrophotographic image forming process, an image forming apparatus employing a process cartridge type in which a photosensitive member and process means actable on the photosensitive member are integrally assembled into a cartridge (unit) and in which this cartridge is mountable in and dismountable from an image forming apparatus main assembly exists.

The process means actable on the photosensitive member includes a cleaning member for electrically charging the photosensitive member, a cleaning member for removing a developer remaining on the photosensitive member, a developing unit for developing an electrostatic latent image on the photosensitive member with the developer, and the like. These process means are integrally assembled together with the photosensitive member into a unit, so that a single cartridge is prepared. The cartridge is made exchangeable at once by a user, so that usability is improved.

Further, Japanese Laid-Open Patent Application (JP-A) 2006-64835 discloses a two-unit constitution in which the above-described cartridge is divided into two cartridges which are made exchangeable separately from each other. Specifically, the photosensitive member, the charging member and the cleaning member are assembled into a single cartridge (hereinafter referred to as a drum cartridge), and the developing cartridge is used as a single cartridge (hereinafter referred to as a developing cartridge). These cartridges are made exchangeable separately from each other. In the following, this cartridge structure (constitution) is referred to as a two-unit structure (constitution).

Advantages of the cartridge with the two-unit structure will be described below. A lifetime of the photosensitive member which is a factor determining a lifetime of the drum cartridge is roughly determined by the print number. On the other hand, an amount of the developer which is one of factors determining a lifetime of the developing cartridge is largely influenced by a print ratio of a print on which an image is printed by a user. The print ratio per (one) sheet of the print varies depending on a print job in some cases, and therefore, the respective cartridges are different in timing when each of the cartridges reaches an end of the lifetime thereof. That is, by causing the cartridge to have the two-unit structure, each of the cartridges can be made usable until the cartridge reaches the end of the lifetime thereof, so that lifetime extension of the cartridge is realized.

Further, in the case of a cartridge employing a contact charging type in which a charging member charges a photosensitive member in contact with the photosensitive member, with lifetime extension of the cartridge, there is a possibility that a developer and fine particles added to a developer surface (hereinafter referred to as an external additive) are accumulated on a surface of a charging roller which is the charging member. This is because with use of the cartridge, the developer and the external additive which are deposited on the photosensitive member gradually pass through a charging member. Thus, in the case where the developer and the external additive are accumulated on the surface of the charging roller improper charging is caused and is visualized as density non-uniformity on a half-tone image. This improper charging is a problem occurring in the latter part of the lifetime of the cartridge and is conspicuous with a longer lifetime of the cartridge.

Therefore, as a measure to solve the problem, a constitution in which a flexible cleaning sheet is contacted to a charging roller and a developer and an external additive (which are hereinafter referred to as a deposited matter) deposited on a surface of the charging roller are removed has been proposed (JP-A 2013-061546). In JP-A 2013-061546, in the constitution in which a cleaning blade which is the charging member contacts a photosensitive member, the deposited matter deposited on the charging roller after passing through between the cleaning blade and the photosensitive member is removed by bringing the cleaning sheet into contact with the charging roller.

Or, as the measure to solve the above-described problem, a constitution in which a surface of a charging roller is provided with unevenness has been proposed (JP-A 2010-48869). In JP-A 2010-48869, the charging roller surface is provided in the unevenness and at a contact portion between a photosensitive member and the charging roller, the photosensitive member is prevented from contacting a recessed portion of the charging roller. As a result, a contact area between the photosensitive member and the charging roller is reduced, so that a degree of deposition of the external additive from the photosensitive member onto the charging roller is reduced.

However, in the case of the two-unit structure consisting of the drum cartridge and the developing cartridge, depending on a use status of a user, an old drum cartridge and a new developing cartridge exist in mixture in some instances. In the case of such a combination, a problem such that an agglomeration of the external additive which has already been collected by the cleaning blade passes through the cleaning blade and thus is deposited on the charging roller surface as it is in a stripe shape with respect to a circumferential direction occurs. An occurrence mechanism of this problem will be described below.

The drum cartridge is used and thus the photosensitive member surface is roughened, so that the drum cartridge is in a state in which the photosensitive member is not readily cleaned. Further, the developer existing in the new developing cartridge is higher in a charge amount than the developer existing in the old developing cartridge, and therefore, a depositing force (electrostatic depositing force) of the developer on the photosensitive member is high and the developer is not readily removed.

Here, the reason why the charge amount of the developer in the new developing cartridge becomes high will be described. In the case of a constitution including a developing chamber including a developer carrying member and a developer accommodating chamber accommodating the developer, the developer moves between the developing chamber and the developer accommodating chamber. For this reason, the developer in the developing cartridges subjected to rubbing (sliding) in a certain proportion when being charged on the developer carrying member. For this reason, with use, the developer is in a state in which chargeability is low due to deterioration by the rubbing (sliding). In view of this, in the case of the above-described developing cartridge, in order to maintain the charge amount of the developer at a minimum necessary level, there is a need to use a developer high in charge amount in a fresh state by taking a lowering in charge amount due to deterioration of the developer into consideration.

As described above, in the combination of the photosensitive member which is not readily cleaned and the developer high in charge amount, when the developer enters the contact portion between the photosensitive member and the cleaning blade, the developer breaks an inhibition layer which is formed by the external additive or the like and which improves a cleaning property. Then, the developer passes together with the agglomeration of the external additive through the contact portion. In this case, the external additive passing through the contact portion is the agglomeration of several μm to several tens of μm, and is different from the case of a normal external additive contaminant which gradually passes through the contact portion and which is gradually deposited on the charging roller. For this reason, even in the constitution in which the charging roller surface is provided with the unevenness of several μm to several tens of um as disclosed in JP-A 2010-48869, the agglomeration of the external additive passed through the contact portion is deposited on the recessed portion of the charging roller surface. Further, the cleaning sheet disclosed in JP-A 2013-061546 cannot contact the external additive deposited on the recessed portion of the charging roller surface, and therefore, a large removing effect cannot be obtained. Further, even when a brush is used as a cleaning member contacted to the charging roller, a fiber diameter of a general-purpose brush is several μm in general. For this reason, the removing effect can be obtained for deposition of toner having a particle size of several μm, but a large removing effect cannot be obtained for deposition of an external additive having a particle size of several nm to several hundreds of nm. Therefore, a stripe-shape image defect occurs in some instances on a halftone image at a portion corresponding to the agglomeration of the external additive deposited on the charging roller.

A principal object of the present invention is to suppress the deposition of the developer on the charging member in the two-unit structure of the cartridge.

SUMMARY OF THE INVENTION

According to an aspect of the present invention, there is provided a drum cartridge mountable in and dismountable from an image forming apparatus without including a developing device, the drum cartridge comprising: an image bearing member; a charging member configured to electrically charge the image bearing member in contact with the image bearing member; and a cleaning member configured to clean the charging member in contact with the charging member, wherein the cleaning member includes an elastic layer contacting the charging member, and the elastic layer comprises a foam member and is made of a material having Asker-C hardness of 5-30 degrees.

Further features of the present invention will become apparent from the following description of exemplary embodiments with reference to the attached drawings.

DESCRIPTION OF THE EMBODIMENTS

Embodiments of the present invention will be described specifically with reference to the drawings. However, dimensions, materials, shapes and relative arrangement of constituent elements described in the following embodiments should be appropriately changed depending on structures and various conditions to which the present invention is applied. Accordingly, the scope of the present invention is not intended to be limited only thereto unless otherwise specified.

Embodiment 1

Figure 2:
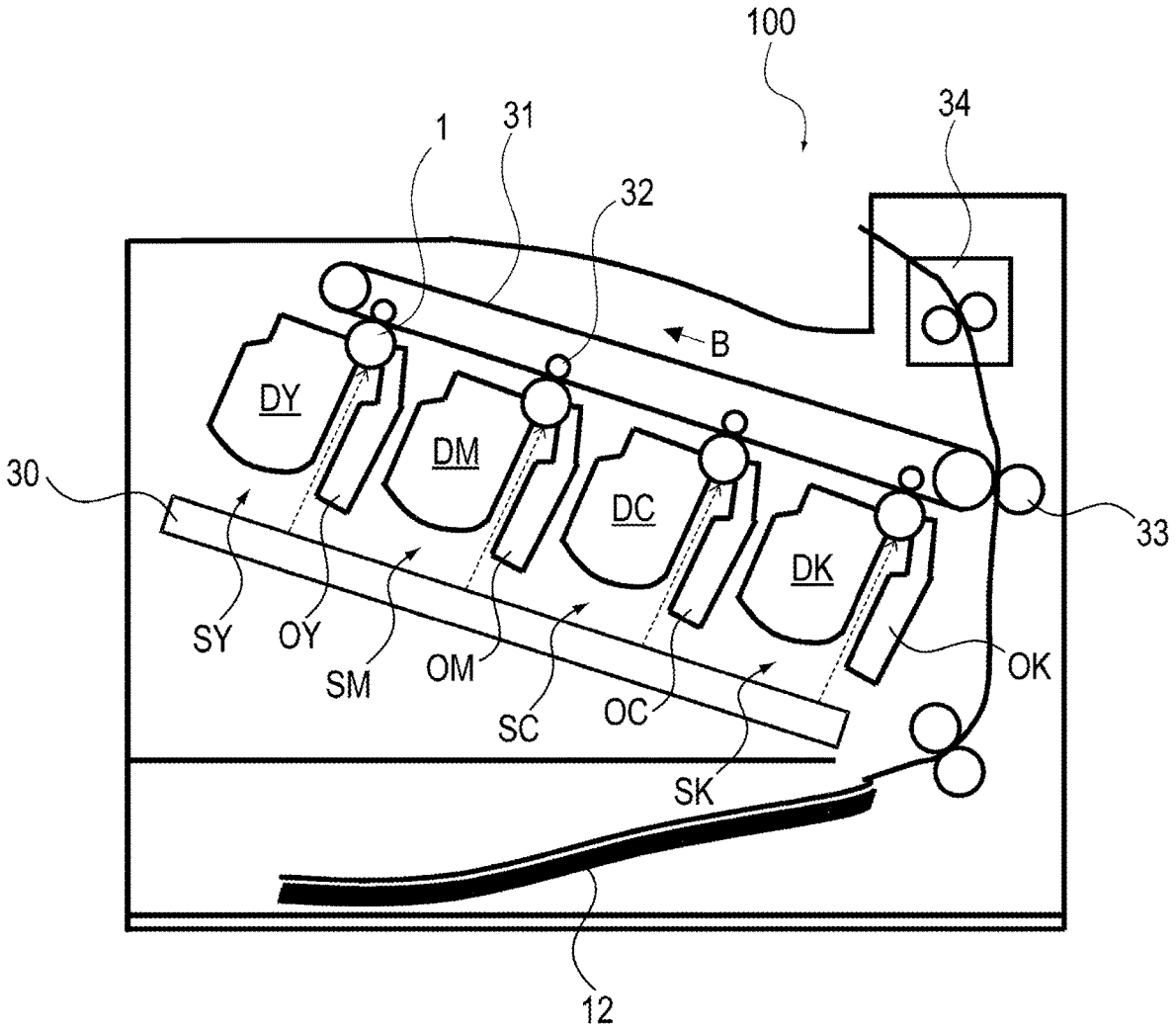
FIG. 2 is an illustration of an image forming apparatus according to the embodiment 1.

A general structure of an (electrophotographic) image forming apparatus including a drum cartridge according to an embodiment 1 will be described. FIG. 2 is a schematic sectional view of an image forming apparatus 100 according to this embodiment. The image forming apparatus 100 shown in FIG. 2 is a full-color laser beam printer employing an in-line type and an intermediary transfer type.

[Image Forming Apparatus]

The image forming apparatus 100 is capable of forming a full-color image on a recording material (such as a recording sheet, a plastic sheet or a cloth) in accordance with image information. The image information is inputted into an image forming apparatus main assembly from an image reading device connected with the image forming apparatus main assembly or a host device such as a personal computer communicatably connected with the image forming apparatus main assembly.

The image forming apparatus 100 includes, as a plurality of image forming portions, image forming portions SY, SM, SC and SK for colors of yellow (Y), magenta (M), cyan (C) and black (K), respectively. Each of the image forming portions SY, SM, SC and SK for the respective colors has a two-unit structure including a single drum cartridge and a single developing cartridge which is a separation member from the drum cartridge. The image forming portions SY, SM, SC and SK include drum cartridges OY, OM, OC and OK, respectively, and include developing cartridges DY, DM, DC and DK, respectively, which are separate members from the drum cartridges. Each of the drum cartridges OY, OM, OC and OK and each of the developing cartridges DY, DM, DC and DK are independently mountable in and dismountable from the image forming apparatus 100 through mounting means such as a mounting guide, a positioning member and the like which are provided in the image forming apparatus main assembly. In the developing cartridges for the respective colors, toners of the respective colors of yellow (Y), magenta (M), cyan (C) and black (K), are accommodated respectively. Incidentally, a structure of each of the respective cartridges will be described later with reference to FIG. 1.

A constitution of this embodiment is such that the single developing cartridge is provided for the single drum cartridge. That is, in the constitution, the single device is provided for a single photosensitive drum of the single drum cartridge. This constitution is capable of increasing in size of the developing cartridge compared with a constitution in which four developing cartridges are provided for the single photosensitive drum, and therefore, is advantageous in lifetime extension of the developing cartridge. However, in the case of this constitution, in order to maintain a minimum necessary toner charge amount even just before an end of the lifetime of the developing cartridge, there is a need to use toner high in charge amount in a fresh state. That is, the constitution of this embodiment in which the single developing cartridge is provided for the single photosensitive drum can meet the lifetime extension compared with the constitution in which the four developing cartridges are provided for the single photosensitive drum, and therefore, is a constitution such that the above-described problem is liable to occur.

The photosensitive drum 1 which is an image bearing member is rotationally driven about rotation center la in an arrow A direction (FIG. 1) by a driving means such as an unshown motor. At a periphery of the photosensitive drum 1, a scanner unit 30 is provided. The scanner unit 30 is an exposure means for forming an electrostatic (latent) image on the photosensitive drum 1 by irradiating a surface of the photosensitive drum 1 with laser light on the basis of the image information. The scanner unit 30 is disposed below the four image forming portions.

An intermediary transfer belt 31 as an intermediary transfer member for transferring toner images from the four photosensitive drums 1 onto a recording material 12 is provided opposite to the four photosensitive drums 1. The intermediary transfer belt 31 is disposed on the four image forming portions.

The intermediary transfer belt 31 formed with an endless belt stretched by a plurality of stretching rollers contacts the four photosensitive drums 1 and circulates and moves (rotates) in an arrow B direction (counterclockwise direction) indicated in FIG. 2.

In an inner peripheral surface side of the intermediary transfer belt 31, as primary transfer means, four primary transfer rollers 32 are juxtaposed so as to oppose the four photosensitive drums 10, respectively. Then, to each of the primary transfer rollers 32, a bias of an opposite polarity to a normal charge polarity of the toner is applied from an unshown primary transfer bias voltage source (high voltage source) as a primary transfer bias application means. As a result, the toner image is transferred (primary-transferred) from the photosensitive drum 1 onto the intermediary transfer belt 31.

In an outer peripheral surface side of the intermediary transfer belt 31, as a secondary transfer means, a secondary transfer roller 33 is provided. Then, to the secondary transfer roller 33, a bias of an opposite polarity to the normal charge polarity of the toner is applied from an unshown secondary transfer bias voltage source (high voltage source) as a secondary transfer bias application means. As a result, the toner images are secondary-transferred from the intermediary transfer belt 31 onto the recording material 12.

For example, during full-color image formation, the above-described process is successively performed in the image forming portions SY, SM, SC and SK, and then the toner images of the respective colors are primary-transferred superposedly onto the intermediary transfer belt 31.

Thereafter, in synchronism with movement of the intermediary transfer belt 31, the recording material 12 is fed to the secondary transfer portion where the secondary transfer roller 33 contacts the intermediary transfer belt 31. Then, by the action of the secondary transfer roller 33 contacting the recording material S toward the intermediary transfer belt 31, the four color toner images are secondary-transferred collectively from the intermediary transfer belt 31 onto the recording material 12.

The recording material 12 on which the toner images are transferred is fed to a fixing device 34 as a fixing means. In the fixing device 34, heat and pressure are applied to the recording material 12, so that the toner images are fixed on the recording material 12.

Figure 1:
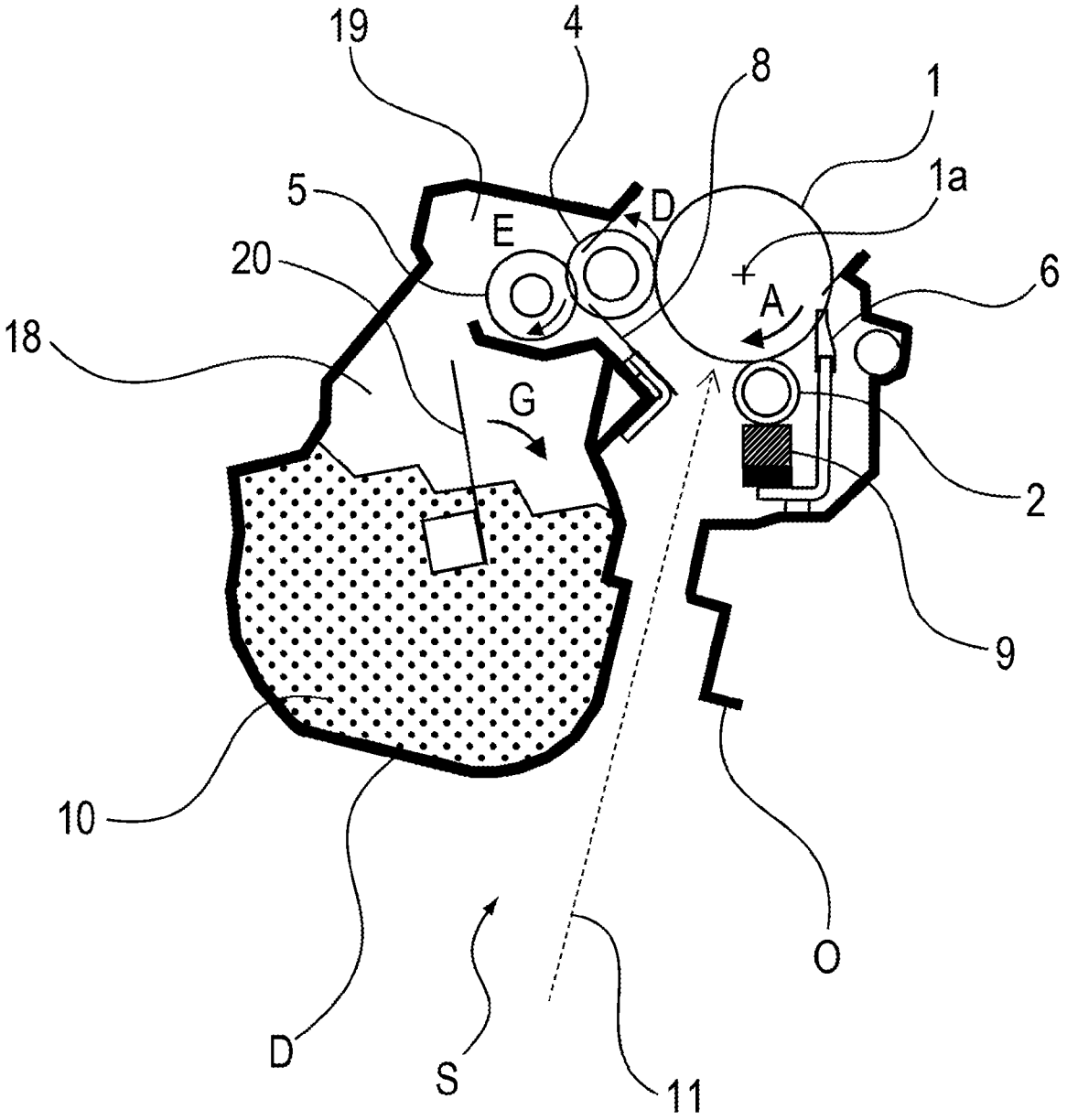
FIG. 1 is an illustration of a drum cartridge according to an embodiment 1 and a developing cartridge.

On the other hand, the photosensitive drum 1 after the toner image is transferred onto the intermediary transfer belt 31 is subjected to subsequent image formation after the toner remaining on the photosensitive drum 1 without being transferred on the intermediary transfer belt 31 is removed by a cleaning member 6 (FIG. 1). The cleaning member 6 in this embodiment is a cleaning blade 6 of an urethane rubber or the like and edge-contacts the surface of the photosensitive drum 1 as shown in FIG. 1. A contact direction of an edge of the cleaning blade 6 is a counter direction to a rotational direction (arrow A direction in FIG. 1) of the photosensitive drum 1. A contact position between the cleaning blade 6 and the photosensitive drum 1 is constituted so as to be below the rotation center la of the photosensitive drum 1 with respect to a direction of gravitation. In this constitution in which the contact position between the cleaning blade 6 and the photosensitive drum 1 is below the rotation center 1 a of the photosensitive drum 1 with respect to the direction of gravitation. On the other hand, in a constitution in which the contact position between the cleaning blade 6 and the photosensitive drum 1 is above the rotation center 1*a* of the photosensitive drum 1 with respect to the direction of gravitation, the external additive scraped off of the surface of the photosensitive drum 1 by the cleaning blade 6 is liable to fall freely. That is, as in the constitution of this embodiment, in the constitution in which the contact position between the cleaning blade 6 and the photosensitive drum 1 is below the rotation center la with respect to the direction of gravitation, compared with the constitution in which the contact position between the cleaning blade 6 and the photosensitive drum 1 is above the rotation center 1*a* with respect to the direction of gravitation, the external additive is liable to accumulate, and therefore, in the constitution of this embodiment, the above-described problem is liable to occur.

[Image Forming Portion]

Next, structures of the drum cartridge O and the developing cartridge D which are the image forming portion S to be mounted in the image forming apparatus so as to be mountable in and dismountable from the image forming apparatus will be described using FIG. 1.

FIG. 1 is a schematic sectional view of the drum cartridge O and the developing cartridge D as seen in a longitudinal direction (rotational axis direction) of the photosensitive drum 1. Incidentally, in this embodiment, constitutions and operations of the drum cartridge O and the developing cartridges D for the respective colors are the substantially same except for colors (Y, M, C, K) of the accommodated developers.

The drum cartridge O includes the photosensitive drum 1 which is the image bearing member, the charging roller 2 which is the charging member, the cleaning blade 6 which is the cleaning member, and a charging member-cleaning member 9 which is another cleaning member (for the charging member). The developing cartridge D includes a developing roller 4 which is the developer carrying member, a supplying roller 5 which is a developer supplying member, toner 10 which is the developer, a developer accommodating chamber 18 which is a developer accommodating portion for accommodating the toner 10, and the like. In this embodiment, the photosensitive drum 1 is 30 mm in diameter, and the developing roller 4 is 16 mm in diameter, and the photosensitive drum 1 and the developing roller 4 oppose each other in a state in which the drum cartridge O and the developing cartridge D are mounted in the image forming apparatus.

In FIG. 1, to the drum cartridge O, the photosensitive drum 1 is rotatably mounted via an unshown bearing. The photosensitive drum 1 is rotationally driven in the indicated arrow A direction in FIG. 1 depending on the image forming operation by receiving a driving force of a driving motor as an unshown photosensitive drum driving means. A peripheral speed of the photosensitive drum 1 in this embodiment is 200 mm/sec.

In the drum cartridge O, the charging roller 2 and the cleaning member 6 are disposed so as to contact the peripheral surface of the photosensitive drum 1. The charging roller 2 contacts the peripheral surface of the photosensitive drum 1 and is rotated by rotation of the photosensitive drum 1. To the charging roller 2, from a charging bias power source (high voltage source) (not shown) as a charging bias applying means, a bias for electrically charging the surface of the photosensitive drum 1 is applied. Further, in the drum cartridge O, the charging member-cleaning member 9 is disposed so as to contact the surface of the charging roller 2. The charging member-cleaning member 9 is the cleaning member for cleaning the charging roller 2 in contact with the charging roller 2. The charging roller 2 and the charging member-cleaning member 9 will be described specifically later.

Then, the drum cartridge O is irradiated with laser light 11 from the scanner unit 30 on the basis of the image information, so that the electrostatic (latent) image is formed on the photosensitive drum 1 charged by the charging roller 2.

On the other hand, the developing cartridge D includes a developing chamber 19 and a developer accommodating chamber 18 disposed below the developing chamber 19. Inside the developer accommodating chamber 18, the toner 10 as the developer is accommodated. The toner 10 in this embodiment is 7 μm in average particle size, and as the external additive, 1.3 weight parts of hydrophobic silica fine power (average particle size: 10 nm) externally added to 100 weight parts of toner particles was used. A normal charge polarity of the toner is negative (polarity), and in the following, the case where a negatively chargeable toner is used will be described.

In the developer accommodating chamber 18, a developer feeding member 20 for feeding the toner 10 to the developing chamber 19 is provided. The developer feeding member 20 feeds the toner 10 to the developing chamber 19 by being rotated in the arrow G direction shown in FIG. 1 through reception of a driving force of a driving motor as unshown developing driving means.

In the developing chamber 19, the developing roller 4 as the developer carrying member rotated in an arrow D direction in FIG. 1 by receiving a driving force from a driving motor as an unshown developing roller driving in contact with the photosensitive drum 1 is provided. In this embodiment, the developing roller 4 and the photosensitive drum 1 rotate so that their surfaces move in the same direction at a contact portion which is an opposing developing cartridge where the oppose each other. A peripheral speed of the developing roller 4 is 300 mm/sec. Further, to the developing roller 4, a bias for developing and visualizing the electrostatic latent image on the photosensitive drum 1 in the toner image is applied from an unshown developing bias power source (high voltage source) as a developing applying means. A developing bias in this embodiment is −300 V.

Further, in the developing chamber 19, the supplying roller 5 which is a developer supplying member for supplying, to the developing roller 4, the toner 10 from the developer accommodating chamber 18, and a regulating member 8 for regulating a coating amount of and imparting electric charges to the toner 10 on the developing roller 4 supplied by the supplying roller 5 are provided. The supplying roller 5 is rotationally driven in an arrow E direction shown in FIG. 1 by receiving a driving force of a driving motor as an unshown developing driving means. In this embodiment, from an unshown voltage source, a supplying bias of −400 V is applied to the supplying roller 5, and a regulating bias of −400 V is applied to the regulating member 8.

A developing constitution in this embodiment employs a so-called contact development type in which the developing roller 4 contacts the photosensitive drum 1. In the contact development type, compared with a so-called jumping development type in which development is carried out by providing a gap between the photosensitive drum 1 and the developing roller 4, the toner 10 having a high charge amount is also used for the development.

That is, the contact development type which is the constitution of this embodiment is a constitution in which the above-described problem is liable to occur since the electrostatic latent image is developed on the photosensitive drum 1 with the toner having the high charge amount compared with the jumping development type.

Further, the supplying roller 5 and the developing roller 4 in this embodiment are rotated so that surfaces thereof move in the same direction at a contact portion therebetween. This constitution is referred to as a "with constitution". On the other hand, a constitution in which the supplying roller 5 and the developing roller 4 are rotated so that their surfaces move in opposite directions at the contact portion therebetween is referred to as a "counter constitution". In the with constitution, compared with the counter constitution, scraping-off power for the toner 10 on the developing roller 4 is low, and therefore, the same toner is repetitively rubbed, and therefore is liable to increase in charge amount. That is, the with constitution which is the constitution in this embodiment is a constitution in which compared with the counter constitution, the scraping-off power is low and the electrostatic latent image is liable to be developed with the toner having the high charge amount, and therefore, the above-described problem is liable to occur.

Further, in this embodiment, the developing chamber 19 including the developing roller 4 and the developer accommodating chamber 18 which is the developer accommodating portion accommodating the toner 10 are integrally assembled into a single cartridge. The toner 10 moves between the developing chamber 19 and the developer accommodating chamber 18, and therefore, all the toner 10 in the developing cartridge is subjected to rubbing (sliding) at a certain proportion when the toner 10 is charged on the developing roller 4. For this reason, the toner 10 just before the end of the lifetime is in a state in which chargeability is low due to deterioration by the rubbing (sliding). In view of this, in the case of the developing cartridge D constitution as in this embodiment, in order to maintain the toner charge amount just before the end of the lifetime at a minimum necessary level, there is a need to use the toner 10 having the high charge amount in a fresh state. On the other hand, in the case of a constitution in which the developer accommodating chamber 18 is provided separately from the developing cartridge D and in which toner corresponding to consumed toner is supplied from the developer accommodating chamber 18 to the developing cartridge D (hereinafter, this constitution is referred to as a "supply constitution"), the toner 10 in the fresh state is always supplied to the developing chamber 19 even just before the end of the lifetime thereof. That is, there is no need to use the toner 10 with high charging power more than necessary in view of the deterioration of the toner 10, so that the charge amount of the toner 10 is not unnecessary increased from an initial stage of use to the end of the lifetime and thus is stabilized. That is, in the constitution including the developer accommodating chamber 18 in which the toner 10 is accommodated as in this embodiment, the toner 10 is liable to deteriorate compared with the constitution in which the toner 10 is supplied from the separately provided developer accommodating portion, and the charge amount of the toner 10 is required to be set at a high level in advance, and therefore, the above-described problem is liable to occur.

(Charging Roller)

The charging roller 2 in this embodiment is constituted by an electroconductive elastic layer and a high-resistance layer. The electroconductive elastic layer comprises a core metal and an about 2.5 mm-thick urethane rubber or the like provided on a peripheral surface of the core metal. The high-resistance layer is a surface layer which is provided on a peripheral surface of the electroconductive elastic layer in a thickness of several μm and which is formed of a material in which carbon black is dispersed in the urethane rubber. Further, in the high-resistance layer which is the surface layer, sphere PMMA (polymethylmethacrylate resin) particles which are roughening particles for providing the surface of the charging roller 2 with unevenness (projections and recesses) are dispersed. This constitution is a constitution for alleviating a degree of deposition, on the charging roller 2, a deposited matter on the photosensitive drum 1 which gradually passes through the cleaning blade 6 during use. In this embodiment, roughening particles of 10 μm in average particle size were used and samples A to D changed in unevenness average interval Sm by changing an amount of the roughening particles for the charging roller 2 were prepared and were subjected to study. Values of ten-point average roughness Rz of surfaces of all the samples A to D were about Rz=5 μm. In Table 1, unevenness average intervals (gaps) Sm of the respective charging rollers are shown. A study result will be described later.

TABLE 1

| Charging roller | Sample A | Sample B | Sample C | Sample D |
|---|---|---|---|---|
| Sm (μm) | 20 | 40 | 60 | 80 |

Both the ten-point average roughness Rz and the unevenness average interval Sm are rough parameters according to JIS-B0601-1994, and were measured in the following condition by using a contact surface roughness measuring device ("SE3500", manufactured by Kosaka Laboratory Ltd.). The condition includes a reference length of 2.0 [mm], an evaluation length of 8.0 [mm], a feeding speed of 0.1 [mm/s] and a filter: Gaussian.

The ten-point average roughness Rz may desirably be 1 μm or more from the viewpoint such that the above-described deposited matter of the photosensitive drum 1 which gradually passes through the cleaning blade 6 is deposited on the charging roller 2. Further, even when the ten-point average roughness Rz is excessively large, charging non-uniformity due to a surface shape of the charging roller 2 occurs, and therefore, the ten-point average roughness Rz may desirably be 30 μm or less. That is, the ten-point average roughness of the surface of the charging roller 2 may desirably satisfy a relationship of 1 μm≤Rz≤30 μm.

When the unevenness average interval Sm is excessively small, a proportion of a projected portion of the charging roller 2 where the deposited matter on the photosensitive drum 1 deposits increases. Further, when the unevenness average interval Sm is excessively large, an interval (gap) between adjacent projections on the surface of the charging roller 2 increases, so that consequently a recessed portion also contacts the surface of the photosensitive drum 1 and thus the deposited matter on the photosensitive drum 1 is deposited on the charging roller 2. For the above-described reasons, the unevenness average interval Sm may desirably satisfy a relationship of 10 μm≤Sm≤200 μm from the viewpoint that the above-described deposited matter on the photosensitive drum 1 which gradually passes through the cleaning blade 6 is deposited on the charging roller.

(Charging Member-Cleaning Member)

The charging member-cleaning member 9 in this embodiment will be described using comparison examples 1 and 2.

The charging member-cleaning member 9 in this embodiment is a cleaning member for cleaning the charging roller 2 in contact with the charging roller 2. The charging member-cleaning member 9 includes an elastic layer contacting the charging roller 2, and the elastic layer is constituted by a foam member. In this embodiment, as the foam member, a commercially available sponge material will be described as an example, but the foam member is not limited thereto.

In this embodiment, as the commercially available sponge material, various insulating polyester-based polyurethane foams were prepared and were used as foam members (elastic layers) contacting the charging roller 2, and study was made. Samples 1 to 10 are sponge materials subjected to the study in this embodiment, and in Table 2, Asker-C hardness, an average cell diameter S and an average skeleton width h of a cell are shown.

TABLE 2

| Charge member-cleaning member | Sample 1 | Sample 2 | Sample 3 | Sample 4 | Sample 5 | Sample 6 | Sample 7 | Sample 8 | Sample 9 | Sample 10 |
|---|---|---|---|---|---|---|---|---|---|---|
| Asker-C hardness (°) | 5 | 10 | 20 | 30 | 40 | 5 | 10 | 20 | 40 | 30 |
| Average cell diameter (μm) | 600 | 500 | 400 | 300 | 250 | 300 | ← | ← | ← | 120 |
| Average skeleton width (μm) | 100 | ← | ← | ← | ← | 50 | 60 | 75 | 120 | 40 |

Measurement of the Asker-C hardness will be described below. The Asker-C hardness was measured using an Asker-C spring rubber hardness meter (manufactured by Kobunshi Keiki Co., Ltd.) according to a measuring method of the Standard SRIS0101 of the Society of Rubber Science and Technology, Japan. A size of each of the measured sponge materials (samples 1 to 10) is 10 mm in height, 30 mm in width and 30 mm in depth. Each of the samples 1 to 10 was placed upward in a plane of the width of 30 mm and the depth of 30 mm, and then the hardness meter was gradually pressed against the sample from above (in the height direction) with a load of 500 g. A numerical value after a lapse of 5 seconds was used as a measured value. A temperature and a humidity during the measurement are 23° C. and 60%RH.

Figure 3:
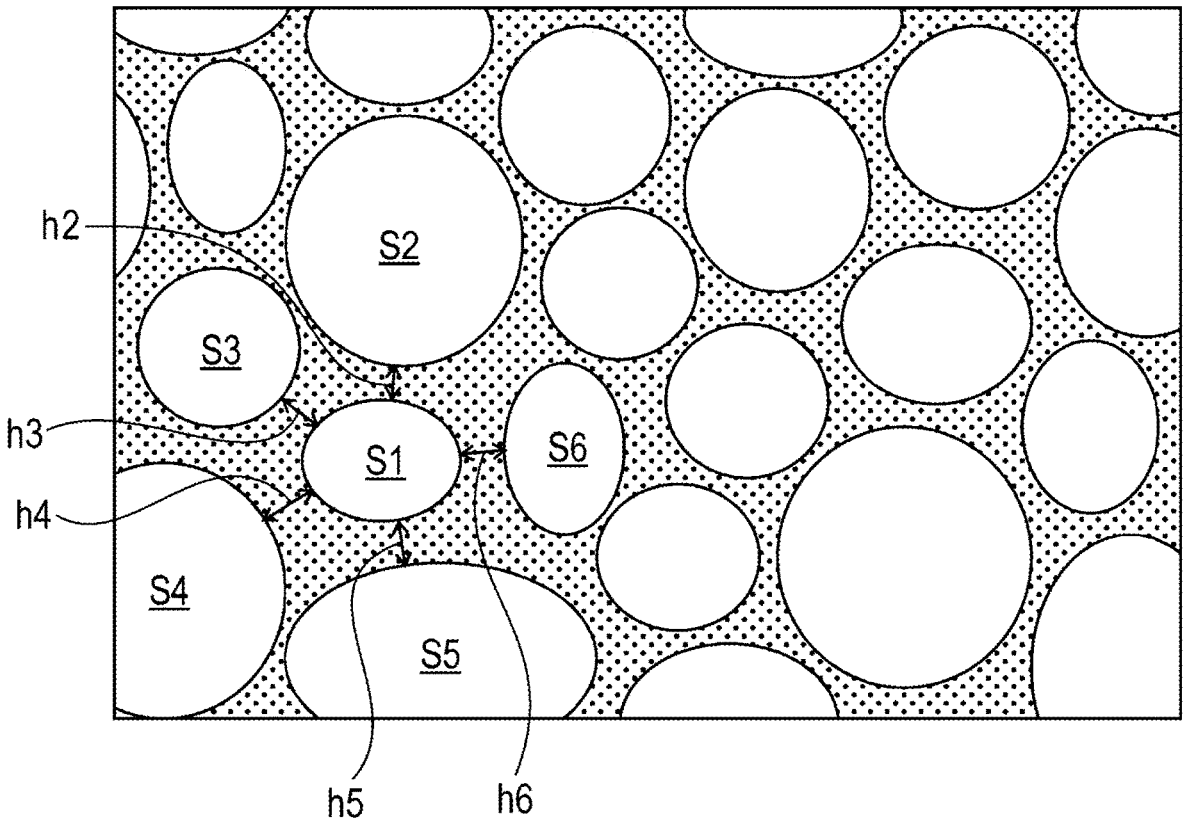
FIG. 3 is an illustration of a measuring method of an average skeleton width of a charging member-cleaning member in the embodiment 1.
Figure 5:
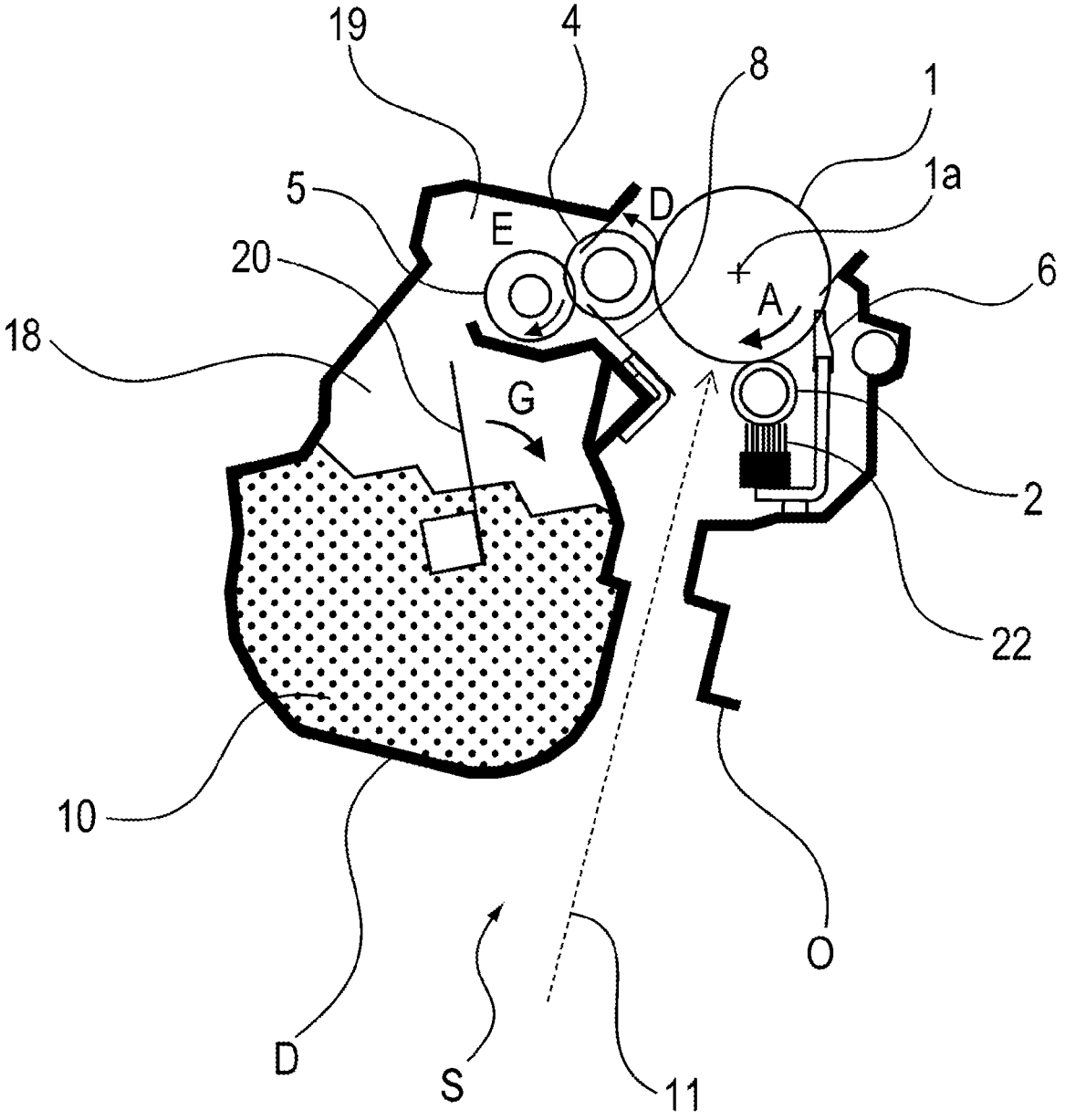
FIG. 5 is an illustration of a drum cartridge and a developing cartridge in a comparison example 2.

The measurement of the average cell diameter S and the average skeleton width h will be described below. The average cell diameter S and the average skeleton width h were measured using a laser microscope ("VK-200", manufactured by KEYENCE Corp.). The sample was observed through an objective lens with a magnification of 20 (times), and a result thereof was binarized. Thereafter, a cell diameter of the cell which is a void of the sponge material and a width of a skeleton constituting the cell were measured. The cell diameter was obtained by converting a measured cell area into a true circle corresponding diameter, and an average of cell diameters of 10 or more cells was calculated and a resultant value was used as the average cell diameter S. As regards the average skeleton width h, a width of a minimum skeleton of skeletons constituting a single cell is used as the skeleton width of the cell. FIG. 3 is a schematic view of a sponge material surface for illustrating the skeleton width. White circle portions are cells, and a dotted portion among the circles represents skeletons which form a structure of the sponge material. Referring to FIG. 3, when a cell S1 is taken as an example, a skeleton width h2 between cells S1 and S2 is minimum compared with skeleton widths h3, h4, h5 and h6 of the cell S1 with other cells S3, S4, S5 and S6, respectively. For this reason, the skeleton width of the cell S1 is h2. The thus-defined skeleton width was measured for 10 or more cells and an average of the measured skeleton widths was used as the average skeleton width h.

in fiber length at a density of 20,000 fibers/cm. This brush member 22 was provided in contact with the charging roller 2 as shown in FIG. 5.

Incidentally, the respective charging member-cleaning members 9 of the samples 1 to 10 are contacted to the charging rollers 2 with a penetration amount (depth) of 500 μm.

(Effect on Charging Roller Contamination with External Additive Agglomeration)

Effects of the samples 1 to 10 of the charging member-cleaning member 9 and the comparison examples 1 and 2 were studied. The contents of the study will be described below. First, the drum cartridge O subjected to printing of a lateral line image with a print ratio of about 2% on 50,000 sheets, and a new developing cartridge D were mounted in the image forming apparatus 100, and then a solid black image was printed on a single sheet and thereafter a uniform halftone image with an image ratio of about 30% was printed on a single sheet. In some halftone images in the constitutions subjected to study, a stripe with respect to an image feeding direction occurred. Further, when surfaces of all the charging rollers 2 subjected to the study were observed, on the surface of the charging roller 2 in the constitution in which the stripe occurred on the image, deposition of external additive agglomeration was observed correspondingly to the stripe occurrence portion. As regards the constitution in which such a result was obtained, an evaluation result was "×". Further, even in the constitution in which the stripe did not occur on the image, although a deposition amount is smaller than a deposition amount in the constitution in which the stripe occurred on the image, the constitution in which deposition of the external additive agglomeration in a stripe shape was observed on the surface of the charging roller 2 also existed in some instances. An evaluation result of such a constitution was "Δ". As regards the constitution in which the stripe did not occur on the image and no deposition of the external additive agglomeration was observed on the surface of the charging roller 2, an evaluation result was "○". The evaluation results are shown in Table 3.

TABLE 3

| | Sample | | Comp. Ex. 1 | Comp. Ex. 2 | Sample 1 | Sample 2 | Sample 3 | Sample 4 | Sample 5 | Sample 6 | Sample 7 | Sample 8 | Sample 9 | Sample 10 |
|---|---|---|---|---|---|---|---|---|---|---|---|---|---|---|
| Charging member-cleaning member | Asker-C hardness (°) | | — | — | 5 | 10 | 20 | 30 | 40 | 5 | 10 | 20 | 40 | 30 |
| | Average cell diameter (μm) | | — | — | 600 | 500 | 400 | 300 | 250 | 300 | ← | ← | ← | 120 |
| | Average skeleton width (μm) | | — | — | 100 | ← | ← | ← | ← | 50 | 60 | 75 | 120 | 40 |
| Charging roller | Sample | Sample B | ← | ← | ← | ← | ← | ← | ← | ← | ← | ← | ← | Sample A | Sample C | Sample D |
| | Sm | 40 | ← | ← | ← | ← | ← | ← | ← | ← | ← | ← | ← | 20 | 60 | 80 |
| Evaluation result | | X | X | Δ | ○ | ○ | Δ | X | Δ | ○ | ○ | X | ○ | Δ | ○ | ○ |

Figure 4:
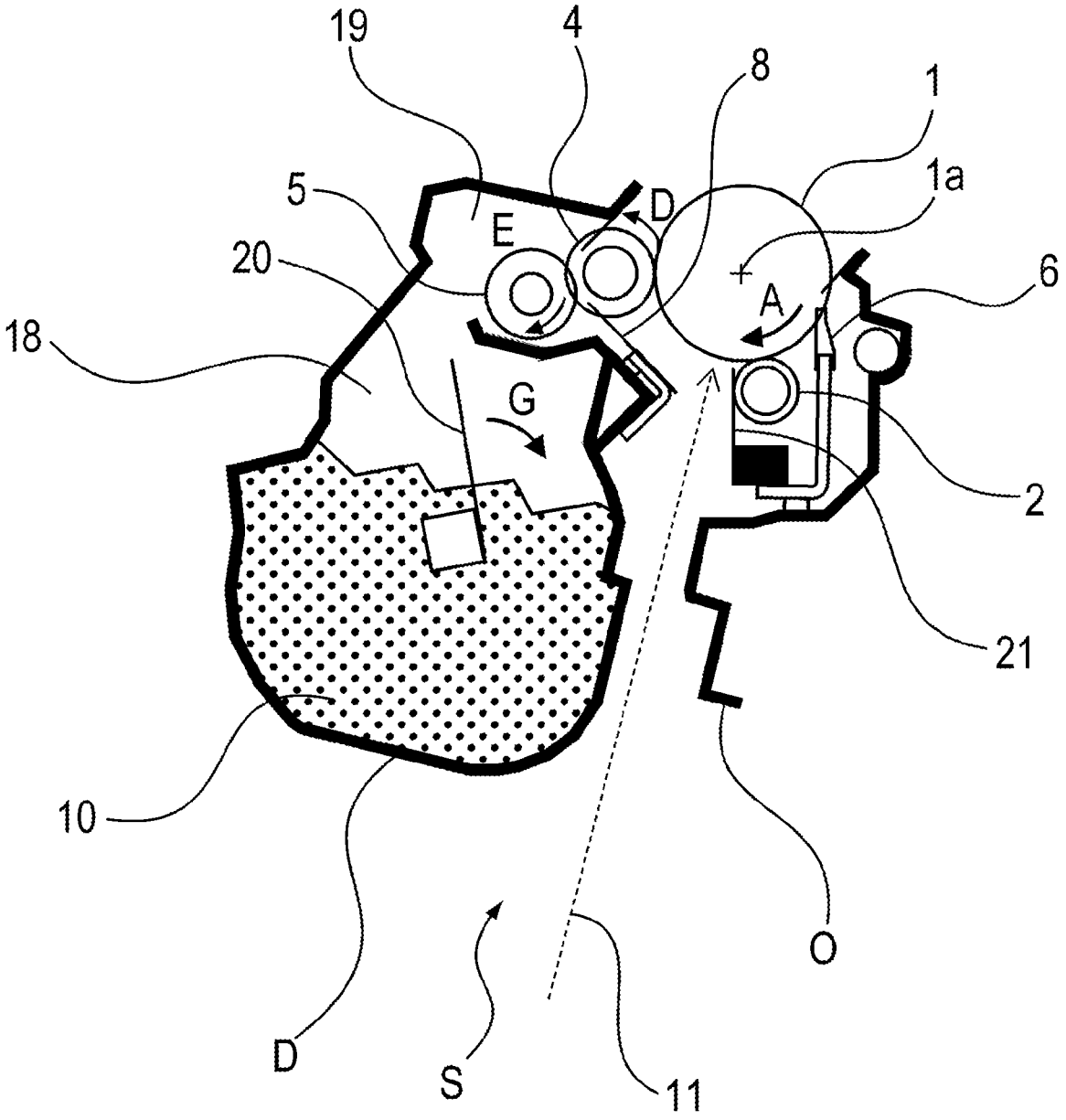
FIG. 4 is an illustration of a drum cartridge and a developing cartridge in a comparison example 1.

A charging member-cleaning member 9 in the comparison example 1 is a 100 μm-thick polyimide sheet member 21. This sheet member 21 was provided in contact with the charging roller 2 as shown in FIG. 4.

A charging member-cleaning member 9 in the comparison example 2 is a brush member 22 which was prepared by planting nylon fibers of 30 μm in fiber diameter and 5 mm The evaluation results shown in Table 3 will be described specifically in the following.

First, the results of the constitutions in which each of the charging member-cleaning members 9 of comparison examples 1 and 2 and the samples 1 to 10 is used as the charging member-cleaning member 9 and a sample B is used as the charging roller 2 will be described.

The evaluation result of the comparison example 1 was "×". When the charging roller 2 for which the stripe image occurred was observed, the external additive at a portion of the charging roller surface where the roughening particles exist, i.e., at a projected portion as a surface shape has been removed. That is, in the case where the sheet member 21 was charging member-cleaning member 9, the sheet member 21 was capable of contacting the projected portion of the charging roller 2, and therefore, the deposited external additive was able to be removed. On the other hand, at the recessed portion of the charging roller 2, the sheet member 21 was not capable of contacting the recessed portion, and therefore, it would be considered that the deposited external additive was not able to be removed and thus the stripe image occurred.

The evaluation result of the comparison example 2 was "×". When the charging roller 2 for which the stripe image occurred was observed, deposition of the external additive was observed at both the projected portion and the recessed portion. When a state of the deposition of the external additive at the recessed portion of the charging roller 2 was compared with that in the case of the comparison example 1, a state in which the developed external additive is pressed against the recessed portion was observed. This would be considered that although the fibers of the brush member 22 are capable of entering the recessed portion, the fibers follow a rotational direction of the charging roller 2, and therefore, the bnish member 22 was not able to attain a large scraping-off effect on the deposition of the external additive of 10 nm in primary particle size.

Next, the samples 1 to 10 will be described. The samples 1 to 10 are the charging member-cleaning members 9 formed of the sponge materials changed in average cell diameter S and average skeleton width h. When the samples 1 to 5 are compared with each other, it is possible to make comparison in which the Asker-C hardness is changed by changing the average cell diameter S while maintaining the average skeleton width h at a certain level. Further, when the samples 4 and 6 to 9 are compared with each other, it is possible to make comparison in which the Asker-C hardness is changed by changing the average skeleton width h while maintaining the average cell diameter S at a certain level.

The evaluation results of the samples 2, 3, 7 and 8 were "○", the evaluation results of the samples 1, 4 and 6 were "Δ", and the evaluation results of the samples 5 and 9 were "×". That is, irrespective of the average cell diameter S and the average skeleton width h, an improving effect on the depositing of the external additive agglomeration on the recessed portion of the charging roller 2 was achieved at the Asker-C hardness of 5° to 30°, and a further improving effect was achieved at the Asker-C hardness of 10° to 20°. This would be considered that the sponge material is capable of entering the interval (gap) between adjacent recessed portions by its own softness and the skeletons forming a sponge structure surface-contact the charging roller 2 and therefore a scraping-off effect even on the deposition of the small external additive of 10 nm in primary particle size can be achieved.

Further, it would be considered that the reason why the evaluation results of the samples 1 and 6 were "Δ" is that the Asker-C hardness is small and thus contact pressure of the sponge material is excessively low and therefore a scraping-off performance somewhat lowers.

Further, it would be considered that the reason why the evaluation result of the sample 4 is "Δ" and the evaluation results of the samples 5 and 9 are "×" is that when the Asker-C hardness becomes large, the sponge materials do not readily enter the recessed portion of the charging roller 2.

Next, the sample 10 will be described. The samples 4 and 10 have the same Asker-C hardness, but are different in average cell diameter S and average skeleton width h. The evaluation result of the sample 4 was "Δ", whereas the evaluation result of the sample 10 is "○". This would be considered that compared with the sample 4, the sample 10 has a small average skeleton width h of 40 μm which is equal to the unevenness average interval Sm of the charging roller 2, and therefore, even when the Asker-C hardness is relatively high, the sponge material was capable of entering the recessed portion of the charging roller 2.

Next, results of a constitutions in which the sample 10 of 40 μm average skeleton width h was used as the charging member-cleaning member 9 and in which samples A to D shown in Table 1 were used as the charging rollers 2 will be described. The evaluation result of the sample A was "Δ", and the evaluation results of the samples B to D were "○". This would be considered that compared with the sample A for which the unevenness average interval Sm is smaller than the average skeleton width h, in the constitutions of the samples B to D for which the unevenness average interval Sm is equal to or larger than the average skeleton width h, the charging member-cleaning members 9 were capable of entering the intervals (gaps) between adjacent recessed portions of the charging roller 2 and therefore the scraping off effect was improved.

From the above-described results, it was able to be confirmed that in the case where the average skeleton width h is not more than the unevenness average interval Sm, even when the Asker-C hardness is relatively high, the charging member-cleaning member 9 is capable of entering the interval (gap) between the adjacent recessed portions of the charging roller 2 and thus the scraping-off effect is improved. That is, it was confirmed that the unevenness average interval Sm of the surface of the charging roller 2 and the average skeleton width h of the foam member of the charging member-cleaning member 9 satisfy a relationship of Sm≥h, whereby even when the Asker-C hardness is relatively high, the scraping-off effect is improved.

As described above, in the case of the two-unit structure consisting of the drum cartridge O and the developing cartridge D, the problem occurring when the drum cartridge O which has been used up, particularly just before the end of the lifetime is combined with a new developing cartridge D was solved (suppressed) in the following manner In order to solve the problem such that the agglomeration of the external additive passes through the cleaning blade 6 and is deposited on the charging roller 2 as it is in the stripe shape with respect to a circumferential direction, the sponge material was used as the charging member-cleaning member 9 and a suppressing effect was achieved when the sponge material had the Asker-C hardness of 5° to 30°. Further, a further suppressing effect was achieved when the Asker-C hardness was 10° to 20°. In addition, a further suppressing effect was achieved when the average skeleton width h of the sponge material which was the charging member-cleaning member 9 was not more than the unevenness average interval Sm of the charging roller 2.

In this embodiment, as the sponge material for the charging member-cleaning member 9, the insulating polyester-based polyurethane foam was used, but the sponge material is not limited thereto. The above-described mechanism is a mechanical scraping-off effect, and therefore, even when an electroconductive sponge material is used, a similar effect can be achieved when the Asker-C hardness and the average skeleton width thereof fall within the above-described ranges.

Further, in this embodiment, description was made using the charging roller 2 provided with the unevenness at the surface thereof by dispersing the roughening particles in the surface layer thereof, but even when the charging roller 2 is provided with the surface unevenness by another method, for example, such a method that the surface unevenness is provided by polishing (abrading) the surface of the charging roller 2 with grindstone or the like, a similar effect can be achieved when the Asker-C hardness and the average skeleton width of the sponge material of the charging member-cleaning member 9 fall within the above-described ranges.

Further, in the constitution in which the single device is disposed for the single photosensitive drum 1, application of the present invention to the cartridge including the photosensitive drum 1, the charging roller 2 and the cleaning member 9 is particularly effective.

Further, a constitution in which the contact position between the cleaning blade 6 and the photosensitive drum 1 is below the rotation axis of the photosensitive drum 1 with respect to the direction of gravitation is employed. In this constitution, the application of the present invention to the cartridge including the photosensitive drum 1, the charging roller 2 and the cleaning member 9 is particularly effective.

Further, in the constitution in which the contact development type in which the developing roller 4 contacts the photosensitive drum 1, the application of the present invention to the cartridge including the photosensitive drum 1, the charging roller 2 and the cleaning member 9 is particularly effective.

Further, in the with constitution in which at the contact portion of the supplying roller 5 with the developing roller 4, the surfaces of these rollers more in the same direction, the application of the present invention to the cartridge including the photosensitive drum 1, the charging roller 2 and the cleaning member 9 is particularly effective.

Further, in the cartridge constitution including the developer accommodating chamber 18 in which the toner 10 is accommodated, the application of the present invention to the cartridge including the photosensitive drum 1, the charging roller 2 and the cleaning member 9 is particularly effective.

Embodiment 2

Figure 6:
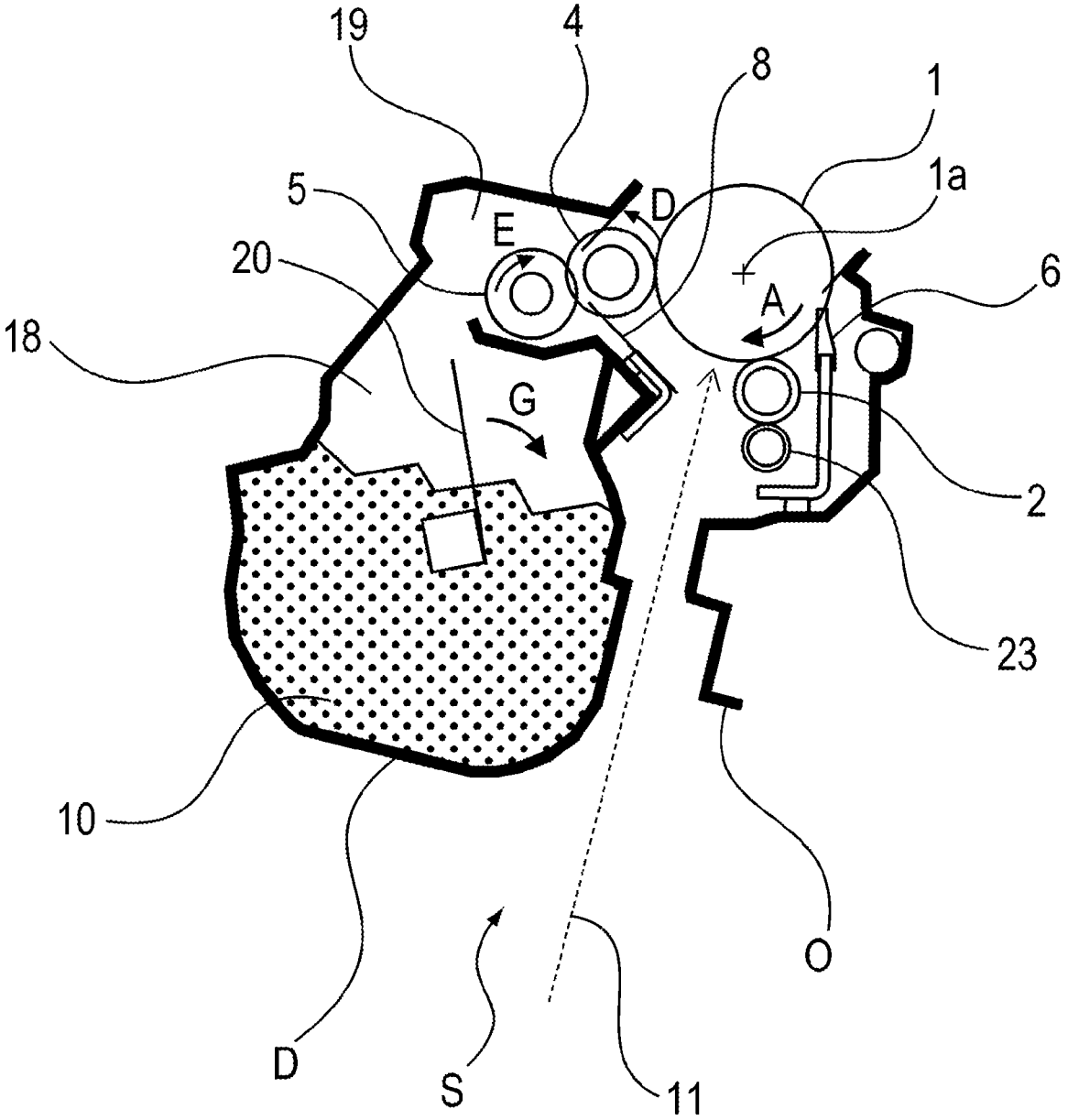
FIG. 6 is an illustration of a drum cartridge according to an embodiment 2 and a developing cartridge.

Using FIG. 6, a cartridge according to an embodiment 2 will be described. The cartridge according to the embodiment 2 also includes the drum cartridge O and the developing cartridge D which are mountable in and dismountable from the image forming apparatus, similarly as in the above-described embodiment 1. FIG. 6 is a schematic sectional view of the drum cartridge O and the developing cartridge D as seen along the longitudinal direction (rotational axis direction) of the photosensitive drum 1. Incidentally, a constitution in which a sponge roller 23 is used as the charging member-cleaning member is employed. Other constituent elements of the cartridge and the structure of the image forming apparatus in which the cartridge is mounted are similar to those in the above-described embodiment, and therefore, members having the same functions will be omitted from description by adding the same reference numerals or symbols.

Also in this embodiment, the same evaluation as that in the embodiment 1 was made. The evaluation result was "○". This would be considered that even in the case where the sponge material as the charging member-cleaning member is formed in the roller shape, when the Asker-C hardness and the average skeleton width h of the sponge material are the same, the charging member-cleaning member 23 was able to enter the recessed portion of the charging roller 2 and therefore an effect similar to the effect of the embodiment 1 was able to be achieved.

In this embodiment, as the sponge material for the sponge roller 23, the insulating polyester-based polyurethane foam was used, but the sponge material is not limited thereto. The above-described mechanism is a mechanical scraping-off effect, and therefore, even when an electroconductive sponge material is used, a similar effect can be achieved when the Asker-C hardness and the average skeleton width thereof fall within the above-described ranges.

Further, in this embodiment, description was made using the charging roller 2 provided with the unevenness at the surface thereof by dispersing the roughening particles in the surface layer thereof, but even when the charging roller 2 is provided with the surface unevenness by another method, for example, such a method that the surface unevenness is provided by polishing (abrading) the surface of the charging roller 2 with grindstone or the like, a similar effect can be achieved when the Asker-C hardness and the average skeleton width of the sponge material of the sponge roller 23 fall within the above-described ranges.

Embodiment 3

Figure 7:
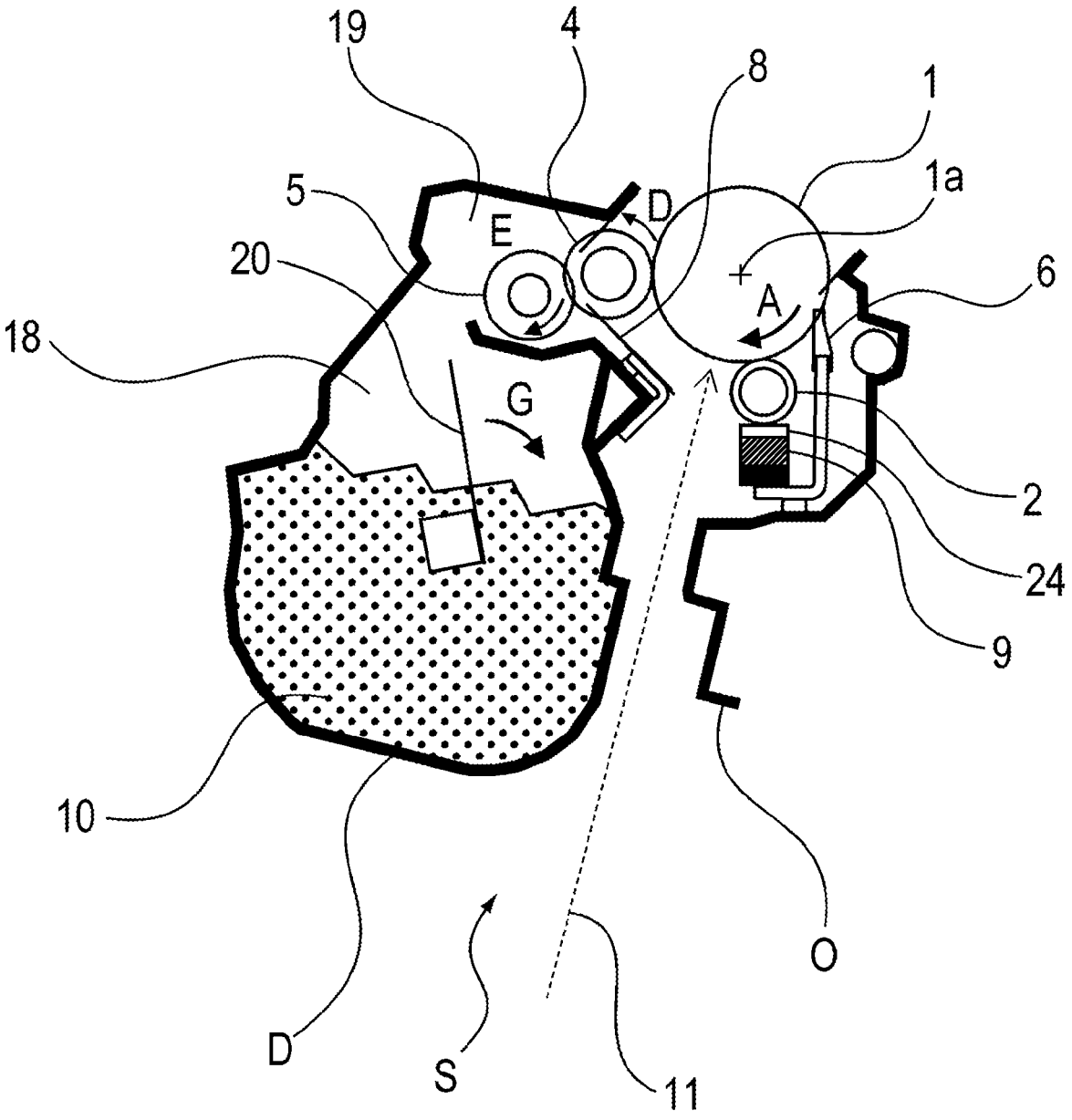
FIG. 7 is an illustration of a drum cartridge according to an embodiment 3 and a developing cartridge.

Using FIG. 7, a cartridge according to an embodiment 3 will be described. The cartridge according to the embodiment 3 also includes the drum cartridge O and the developing cartridge D which are mountable in and dismountable from the image forming apparatus, similarly as in the above-described embodiment 1. FIG. 7 is a schematic sectional view of the drum cartridge O and the developing cartridge D as seen along the longitudinal direction (rotational axis direction) of the photosensitive drum 1.

In the above-described embodiment 1, as the charging member-cleaning member 9, the sponge material which is the foam member contacting the charging roller 2 was used, but the charging member-cleaning member 9 is not limited thereto. In this embodiment, as the charging member-cleaning member 9, a member prepared by bonding a nonwoven fabric 24 to the sponge material of the sample 10 described in the embodiment 1 was used. The nonwoven fabric 24 was bonded to the surface of the sponge material where the sponge material faces the charging roller 2. That is, the charging member-cleaning member 9 according to this embodiment is the member prepared by bonding the nonwoven fabric 24 to the surface of the sponge material which is the foam member so that the nonwoven fabric 24 contacts the charging roller 2. As the nonwoven fabric 24, a commercially available nonwoven fabric was used. A nonwoven fabric 24 with a fiber diameter r of 10 μm was used as a sample Y, and a nonwoven fabric 24 with the fiber diameter r of 30 μm was used as a sample Z. Other constituent elements of the cartridge and the structure of the image forming apparatus in which the cartridge is mounted are similar to those in the above-described embodiments, and therefore, members having the same functions will be omitted from description by adding the same reference numerals or symbols.

Also in this embodiment, the same evaluation as that in the embodiment 1 was made. As the charging roller 2, the charging roller of the sample A was used. An evaluation result is shown in Table 4.

TABLE 4

| | Sample | Sample 10 |
|---|---|---|
| Charging Member-cleaning member | ACH*1 (° C.) | 30 |
| | ACD*2 (μm) | 120 |
| | ASW*3 (μm) | 40 |

| | Sample | Sample A |
|---|---|---|
| Charging roller | Sm (μm) | 20 |

| | Sample | Sample Y | Sample Z |
|---|---|---|---|
| Nonwoven fabric | Fiber diameter (μm) | 10 | 30 |
| | Evaluation result | ○ | x |

*1"ACH" is the Asker-C hardness.
*2"ACD" is the average cell diameter.
*3"ASW" is the average skeleton width.

The evaluation result of the constitution using the nonwoven fabric of the sample Y was "○". In embodiment 1, the evaluation result of the constitution in which the sample 10 is used as the charging member-cleaning member 9 and the sample A is used as the charging roller 2 was "Δ", and therefore, the evaluation result is improved by using the nonwoven fabric of the sample Y.

This would be considered that fibers of the nonwoven fabric 24 can enter the intervals (gaps) between the adjacent recessed portions of the charging roller 2 by using the sample Y having the fiber diameter r of 10 μm which is smaller than the unevenness average interval Sm of the charging roller 2 and different from the brush, the fibers of the nonwoven fabric 24 do not readily follow the rotational direction of the charging roller 2 and therefore an effect of suppressing the deposition of the external additive onto the charging roller 2 was improved.

Further, the evaluation result of the constitution using the nonwoven fabric 24 of the sample Z was "x". This would be considered that the sample Z having the fiber diameter r of 30 μm which is larger than the unevenness average interval Sm of the charging roller 2 is used and therefore the fibers of the nonwoven fabric 24 cannot enter the intervals between the adjacent recessed portions and thus the improving effect was not achieved.

From these results, it was able to be confirmed that the fibers of the nonwoven fabric 24 can enter the intervals between the adjacent recessed portions of the charging roller 2 by using the nonwoven fabric 24 having the fiber diameter r which is smaller than the unevenness average interval Sm of the charging roller 2 and thus the improving effect can be achieved. That is, it was able to be confirmed that the unevenness average interval Sm of the surface of the charging roller 2 and the fiber diameter r of the nonwoven fabric 24 of the charging member-cleaning member 9 satisfy the relationship of Sm>r and thus the effect of suppressing the deposit of the external additive onto the charging roller 2 can be achieved.

In this embodiment, the nonwoven fabric 24 was bonded to the sponge material of the charging member-cleaning member 9, but when a constitution in which Sm>r is satisfied and fibers do not follow the rotational direction of the charging roller 2 is employed, the charging member-cleaning member 9 is not limited thereto.

Other embodiments

In the above-described embodiments, the four image forming portions each having the two-unit structure consisting of the single drum cartridge O and the single developing cartridge D are used, but the number of use of the cartridges is not limited thereto and may be appropriately changed as desired.

In the above-described embodiments, the image forming apparatus in which the single drum cartridge O and the single developing cartridge D are mountable in and dismountable from the image forming apparatus was described as an example, but the image forming apparatus is not limited thereto. An image forming apparatus in which a cartridge including the single drum cartridge and the single developing cartridge is mountable in and dismountable from the image forming apparatus may also be employed. A similar effect can be achieved by applying the present invention to the cartridge mounted in the image forming apparatus so as to be mountable in and dismountable from the image forming apparatus.

In the above-described embodiments, as the image forming apparatus 100, the printer was illustrated, but the present invention is not limited thereto. For example, other image forming apparatuses such as a copying machine, a facsimile machine, a multi-function machine having functions of these machines may also be used. Further, the image forming apparatus 100 in which intermediary transfer member 31 is used and in which the toner images of the respective colors are successively transferred superposedly onto the intermediary transfer member 31 and then are collectively transferred from the intermediary transfer member 31 onto the recording material 12 was described as an example, but the present invention is not limited thereto. An image forming apparatus in which a recording material carrying member is used and in which the toner images of the respective colors are successively transferred superposedly onto a recording material carried on the recording material carrying member may also be used. By applying the present invention to cartridges mounted in these image forming apparatuses so as to be mountable in and dismountable from the image forming apparatuses, an effect similar to those in the above-described embodiments can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-212650 filed on Nov. 13, 2018, which is hereby incorporated by reference herein in its entirety.

What is claimed is:

1. A drum cartridge mountable in and dismountable from an image forming apparatus without including a developing device, the drum cartridge comprising:

an image bearing member;

a rotatable charging roller configured to electrically charge the image bearing member in contact with the image bearing member, the charging roller including unevenness on a surface thereof contacting the image bearing member; and a cleaning member configured to clean the charging roller in contact with the charging roller, wherein the cleaning member includes an elastic layer contacting the charging roller, and the elastic layer comprises a foam member and is made of a material having Asker-C hardness of 5-30 degrees, the foam member being made of a sponge material having voids, wherein the charging roller satisfies the following relationship:

$Sm \geq h$, where Sm is an unevenness average interval on the surface of the charging roller, and when the distance to the nearest void in each voids is defined as a skeleton width, h is an average skeleton width which is an average value of the skeleton width on the surface of the sponge material in each void.

2. A drum cartridge according to claim 1, wherein the charging roller satisfies the following relationship:

$1\ \mu m \leq Rz \leq 30\ \mu m$ where Rz is a ten point average roughness of the surface of the charging roller.

3. A drum cartridge according to claim 1, wherein the cleaning member has a roller shape.

4. A drum cartridge according to claim 1, further comprising, a second cleaning member configured to remove a developer on the image bearing member in contact with the image bearing member, wherein when the drum cartridge is mounted in the image forming apparatus a contact position between the second cleaning member and the image bearing member is below a rotation center of the image bearing member with respect to a direction of gravitation.

5. An image forming apparatus comprising:

a developing cartridge including a developer, a developing device configured to develop an electrostatic latent image on an image bearing member with the developer, and a developer accommodating portion configured to accommodate the developer, wherein the developing cartridge is mountable in and dismountable from the image forming apparatus; and a drum cartridge according to claim 1 which is mountable in and dismountable from the image forming apparatus separately from the developing cartridge.

6. An image forming apparatus according to claim 5, comprising a cartridge including the drum cartridge and the developing cartridge, wherein the cartridge is mountable in and dismountable from the image forming apparatus.

7. A drum cartridge mountable in and dismountable from an image forming apparatus without including a developing device, the drum cartridge comprising:

an image bearing member;

a charging member configured to electrically charge the image bearing member in contact with the image bearing member; and a cleaning member configured to clean the charging member in contact with the charging member, the cleaning member including a nonwoven fabric contacting the charging member, wherein the cleaning member includes an elastic layer contacting the charging member, and the elastic layer comprises a foam member and is made of a material having Asker-C hardness of 5-30 degrees, wherein the charging member and the cleaning member satisfy the following relationship:

$Sm > r$, where Sm is an unevenness average interval on a surface of the charging member, and r is a fiber diameter of the nonwoven fabric.

8. A drum cartridge according to claim 7, wherein the charging member has a structure in which the nonwoven fabric is bonded to a surface of the foam member contacting the charging member.

9. A cartridge comprising:

a drum cartridge including an image bearing member;

a rotatable charging roller configured to electrically charge the image bearing member in contact with the image bearing member; and a cleaning member configured to clean the charging roller in contact with the charging roller, wherein the drum cartridge is mountable in and dismountable from an image forming apparatus; and a developing cartridge including a developer, a developing member configured to develop an electrostatic latent image on the image bearing member with the developer, a supplying member configured to supply the developer to the developing member at a contact portion which is the supplying member is in contact with the developing member and a developer accommodating portion configured to accommodate the developer, wherein the developing cartridge is mountable in and dismountable from the image forming apparatus, wherein the supplying member and the developing member are rotated so that a surface of the supplying member and a surface of the developing member move in a same direction at the contact portion therebetween, wherein the cleaning member includes an elastic layer contacting the charging roller, and the elastic layer comprises a foam member and is made of a material having Asker-C hardness of 5-30 degrees, and wherein the charging roller satisfies the following relationship:

$10\mu m \leq Sm \leq 200\mu m$, where Sm is an unevenness average interval on the surface of the charging roller.

* * * * *